US007210533B2

(12) United States Patent
Starr et al.

(10) Patent No.: US 7,210,533 B2
(45) Date of Patent: May 1, 2007

(54) DISPOSABLE DOWNHOLE TOOL WITH SEGMENTED COMPRESSION ELEMENT AND METHOD

(75) Inventors: Phillip M. Starr, Duncan, OK (US); Loren C. Swor, Duncan, OK (US); Kenneth L. Schwendemann, Lewisville, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 231 days.

(21) Appl. No.: 10/776,820

(22) Filed: Feb. 11, 2004

(65) Prior Publication Data

US 2005/0173126 A1 Aug. 11, 2005

(51) Int. Cl.
*E21B 29/00* (2006.01)
*E21B 33/12* (2006.01)

(52) U.S. Cl. ..... 166/376; 166/118; 277/323; 277/340

(58) Field of Classification Search ..... 166/118, 166/376; 277/323, 340
See application file for complete search history.

(56) References Cited

U.S. PATENT DOCUMENTS

| | | | | |
|---|---|---|---|---|
| 2,204,659 | A * | 6/1940 | Burt | 166/217 |
| 2,780,294 | A | 2/1957 | Loomis | |
| 3,062,295 | A * | 11/1962 | Hanes | 277/337 |
| 3,298,440 | A * | 1/1967 | Current | 277/340 |
| 3,530,934 | A * | 9/1970 | Kisling | 166/134 |
| 4,720,113 | A | 1/1988 | Hertz, Jr. | 277/165 |
| 4,784,226 | A * | 11/1988 | Wyatt | 166/376 |
| 5,038,859 | A | 8/1991 | Lynde et al. | |
| 5,350,016 | A * | 9/1994 | Thornton, Jr. | 166/120 |
| 5,603,511 | A | 2/1997 | Keyser, Jr. et al. | 277/115 |
| 5,701,959 | A * | 12/1997 | Hushbeck et al. | 166/387 |
| 6,102,117 | A | 8/2000 | Swor et al. | 166/138 |
| 6,334,488 | B1 * | 1/2002 | Freiheit | 166/192 |
| 6,578,633 | B2 * | 6/2003 | Slup et al. | 166/118 |
| 6,793,022 | B2 * | 9/2004 | Vick et al. | 166/382 |
| 2003/0168214 | A1 | 9/2003 | Sollesnes | 166/250.08 |
| 2003/0213601 | A1 | 11/2003 | Schwendemann et al. | |

FOREIGN PATENT DOCUMENTS

EP 0 743 422 A3 2/1998

OTHER PUBLICATIONS

Foreign communicatin from related counter part application dated May 25, 2005.
U.S. Patent Application entitled "Method for Removing a Tool From a Well", by Phillip M. Starr et al., U.S. Appl. No. 10/765,509, filed Jan. 27, 2004.
SPE 84328 entitled "Application of Flow-Thru Composite Frac Plugs in Tight-Gas Sand Completions", by Mike Eberhard et al., dated 2003.
Paper entitled "Fas Drill® Frac Plug" dated 2003.

* cited by examiner

*Primary Examiner*—Jennifer H. Gay
*Assistant Examiner*—Shane Bomar
(74) *Attorney, Agent, or Firm*—John W. Wustenberg; Baker Botts, L.L.P.

(57) ABSTRACT

A disposable downhole tool includes an elongated body and a compression element. The compression element is disposed about the elongated body. The compression element includes at least one preconfigured division at disposal of the disposable downhole tool.

38 Claims, 3 Drawing Sheets

DISPOSABLE DOWNHOLE TOOL WITH SEGMENTED COMPRESSION ELEMENT AND METHOD

BACKGROUND

Methods and apparatus for preparing and treating a well, and more particularly to a disposable downhole tool with a segmented compression element and method are disclosed.

In treating and preparing a subterranean well for production, a packer or plug is often used to isolate zones of the wellbore. Packers and plugs are selectively expandable downhole devices that prevent or control the flow of fluids from one zone of the wellbore to another. For example, during production enhancement operations a packer or plug may be used to isolate a treatment zone from the remaining zones of the wellbore.

Packers and plugs are run into a wellbore on a work string. Seal elements are expanded radially to seal the packer or plug against the wellbore. The seal elements may be hydraulically or mechanically expanded. After a packer has been set, it seals the annulus of the wellbore to block movement of fluids through the annulus past the packer location. After a plug has been set, it seals the entirety of the wellbore to block the movement of fluids past the plug location. A plug may include a check value to permit flow in one direction while preventing flow in the other direction. Once set, packers and plugs typically maintain the sealing engagement against the wellbore until released.

Packers and plugs may be retrievable or drillable (millable). A retrievable tool is typically released from the wellbore by manipulation of the connected work string and then retrieved to the surface. A drillable tool may be composition cast-iron disposed of by inserting a drill bit or other drilling tool into the wellbore and mechanically breaking up the tool by drilling.

SUMMARY

A disposable downhole tool with a segmented compression element is provided for use in oil, gas, and other wells. The segmented compression element may in one embodiment be segmented prior to deployment of the disposable downhole tool. In another embodiment, the segmented compression element may be segmented downhole in response to setting or release of the disposable downhole tool or other downhole event. For example, the segmented compression element may be cut during or after setting.

In accordance with a particular embodiment, a disposable downhole tool includes a body and a compression element situated about the body. The compression element includes at least one preconfigured division at disposal of the disposable downhole tool, which may aid the disposal process.

More specifically, the compression element may in some embodiments include a plurality of preconfigured divisions segmenting the compression element into a plurality of segments. The segments may be substantially uniform in size and shape or may be differently configured. In specific embodiments, the preconfigured divisions may be at least partially preformed prior to deployment of the disposable downhole tool in the wellbore. In some of these and other embodiments, the preconfigured divisions may be at least partially formed downhole in a wellbore in response to a segmenting event. The segmenting event may be the setting of the disposable downhole tool, release of the disposable downhole tool, or other suitable event.

Technical advantages of one or more embodiments of the disposable downhole tool and method include providing a disposable downhole tool that can be readily disposed of in a wellbore without drilling. In a particular embodiment, one or more compression elements of the disposable downhole tool are segmented into a plurality of segments to aid the disposal process by, for example, preventing or reducing the likelihood of the compression element becoming lodged in the wellbore. The segments may be configured to sink to the bottom of the wellbore with a remainder or other part of the disposable downhole tool or may be removed by circulation of fluid in the wellbore. As a result, a packer, plug, or other suitable downhole tool may be disposed of in the wellbore without costly and time consuming retrieval or drilling operations.

Another technical advantage of one or more embodiments of the disposable downhole tool and method include providing a packer, plug, or other sealing tool with a segmented sealing element. The segmented sealing element may include a plurality of segmented compression elements. Divisions in the segmented compression elements may be offset from each other to prevent or reduce fluid flow through the sealing element.

Various embodiments of the disposable downhole tool and method may include all, some, or none of the above or elsewhere described advantages. Moreover, other technical advantages may be readily apparent from the following figures, descriptions, and claims.

DETAILED DESCRIPTION

Figure 1:
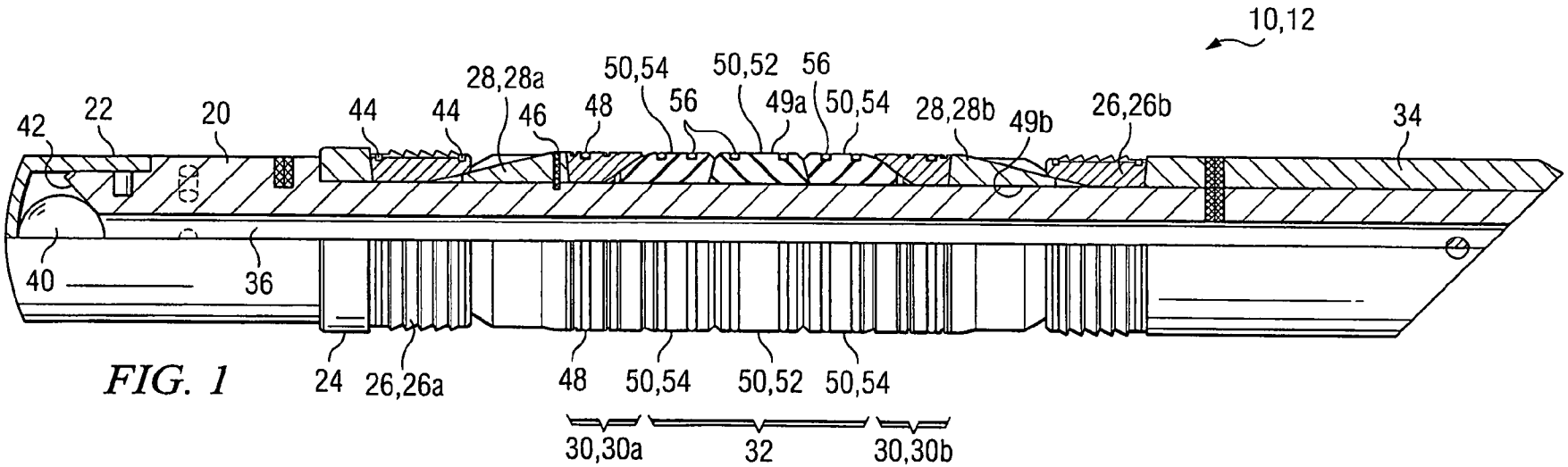
FIG. 1 illustrates one embodiment of a disposable downhole tool.

FIG. 1 illustrates one embodiment of a disposable downhole tool 10. In this embodiment, the disposable downhole tool 10 is a disposable well plug 12. The disposable well plug 12 may be, for example, a free plug. In other embodiments, the disposable downhole tool 10 may be a disposable well packer or other disposable downhole device with an annularly expandable seal or other assembly with one or more compression elements.

Referring to FIG. 1, the disposable well plug 12 includes an elongated body 20, a cage 22 at the upper end of the elongated body 20, a spacer ring 24, slips 26, wedges 28, extrusion limiters 30, a sealing element 32, and a mule shoe 34. The slips 26, wedges 28, extrusion limiters 30, and sealing element 32 as well as other components of the disposable well plug 12 may each be an annular element situated about the elongated body 20.

A main longitudinal passageway 36 extends through elongated body 20 along the longitudinal axis and forms the interior of the elongated body 20. The elongated body 20 is substantially longer than it is wide and may have a cross-section that is circular or otherwise suitably shaped. In the circular cross-section embodiment, the elongated body 20 is cylindrical. The elongated body 20 forms a frame for the disposable well plug 12 and may be formed of one or more pieces. The elongated body 20 may comprise a composite, magnesium, ceramic, or other suitable material for the disposable downhole tool 10. The elongated body 20 and other elements of the disposable well plug 12 may be structural elements in that they provide strength, rigidity, or other characteristics for the disposable downhole tool 10.

The cage 22 receives a ball 40. The ball 40 seals in a ball seat 42 to prevent downward fluid flow and lifts from the ball seat 42 to allow upward fluid flow. Thus, the ball 40 prevents fluid flow downwardly through the main longitudinal passageway 36 of the elongated body 20, but permits fluid flow upwardly through the main longitudinal passageway 36.

The slips 26 may include an upper slip 26*a* and a lower slip 26*b*. The slips 26 may each be formed of a number of segments held in place by slip retaining rings 44. The slips 26 may each comprise cast iron, composite, or other suitable rigid material. A rigid material is any material that is at least substantially rigid, substantially non-flexible, and/or essentially non-compressible.

The wedges 28 may include an upper wedge 28*a* and a lower wedge 28*b*. The wedges 28 each include a ramp for setting the corresponding adjacent slip 26 and are held in place by a pin 46. The wedges 28 may be comprised of phenolic or other suitable rigid materials.

The extrusion limiters 30 may include an upper extrusion limiter 30*a* and a lower extrusion limiter 30*b*. The extrusion limiters 30 each include an anti-extrusion lip that engages the corresponding edge of the sealing element 32. The extrusion limiters 30 may each be formed of a number of segments held in place by retaining rings 48. The segments may comprise complex overlapping shapes and be formed of Phenolic or other rigid materials.

The sealing element 32 comprises a radially expandable seal assembly situated about the elongated body 20. The sealing element 32 has an outer axial surface 49*a* and an inner axial surface 49*b*. When the disposable well plug 12 is in a relaxed position, for example during positioning the disposable well plug 12 in a wellbore, a gap exists between the outer axial surface 49*a* of the sealing element 32 and the wall or casing of the wellbore. As described in more detail below, when the disposable well plug 12 is set in a wellbore, the sealing element 32 is compressed along the longitudinal axis of the disposable well plug 12 and expanded to form a seal between the elongated body 20 of the disposable well plug 12 and the casing 130 (FIG. 5) of the wellbore.

In one embodiment, the sealing element 32 comprises one or more compression elements 50. The compression elements 50 are each an elastic, compressive, and deformable element. The compression elements 50 may comprise any suitable material that deforms substantially or otherwise suitably under pressure or other application of force, that provides an annular or other suitable seal, and/or that stores energy when set. The compression elements 50 may be rubber or other suitable elastomer having a shore durometer A scale hardness above about thirty. For example, the compression elements 50 may be formed of nitrile rubber, AFLAS fluororubber, VITON rubber, and the like. Other suitable materials may be used depending on the temperatures and pressures to be experienced by the disposable well plug 12.

In the illustrated embodiment, the sealing element 32 comprises a center compression element 52 bounded on each side by an end compression element 54. In this and other embodiments, the compression elements 50 are each a pre-segmented annular sealing ring disposed about the elongated body 20 and held in place by one or more retaining rings 56. The retaining rings 56 may be a flexible, rubber or other suitable o- ring, a flexible metal or other band, a garder or other suitable spring. The retaining rings 56 may also comprise any fracturable constraint, such as composite bands. The retaining rings 56 may extend completely, substantially, or partially around the end compression elements 54 and may be formed from one or more parts. Further details of the center compression element 52 and the end compression elements 54 are described in connection with FIGS. 2–3.

The compression elements 50 may in one embodiment vary in hardness in the longitudinal direction of the sealing element 32. In this embodiment, the outermost or end compression elements 54 may be the hardest and the innermost or center compression element 52 the softer. In a particular embodiment, the end compression elements 54 may have a shore durometer A scale hardness of between about forty and about ninety-five. In this embodiment, the center compression element 52 may have a shore durometer A scale hardness of between about fifty and about seventy-five.

Figure 2:
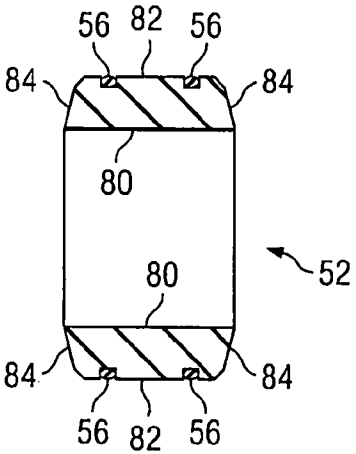
FIG. 2 illustrates one embodiment of a center compression element of the disposable downhole tool of FIG. 1.

FIG. 2 illustrates details of the center compression element 52 in accordance with one embodiment. In this embodiment, the center compression element 52 is situated and configured to fit between the set of end compression elements 54. It will be understood that the center compression element 52 may be otherwise suitably situated and/or shaped without departing from the scope of the present invention.

Referring to FIG. 2, the center compression element 52 may have a trapezoidal cross-sectional shape. In this embodiment, the major base of the trapezoid may be at an inside axial surface 80 of the center compression element 52. As a result, the center compression element 52 is thicker, in the axial direction of the disposable well plug 12, at the inside axial surface 80 than at an outside axial surface 82. The axial direction of the disposable well plug 12 is the direction parallel to the longitudinal axis of the elongated body 20.

The seams 84 of the center compression element 52 are substantially straight, and, as viewed in cross-section, diverge toward the inside axial surface 80 of the center compression element 52. In one embodiment, the seams 84 may diverge on an acute, or shallow, angle. The center compression element 52 may be otherwise suitably shaped.

Figure 3:
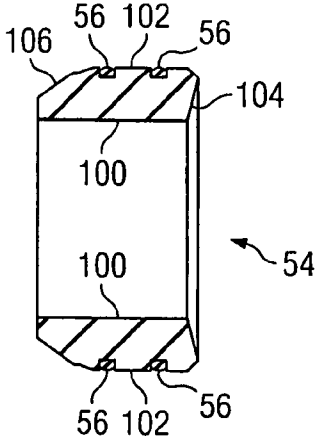
FIG. 3 illustrates one embodiment of an end compression element of the downhole disposable tool of FIG. 1.

FIG. 3 illustrates details of the end compression elements 54 in accordance with one embodiment. In this embodiment, the end compression elements 54 bound the center compression element 52 and form the outermost layers of the sealing element 32.

Referring to FIG. 3, the end compression element 54 has an inner axial surface 100 and an outer axial surface 102. An inner seam 104 may be configured to abut and/or mate with the adjacent seam 84 of the center compression element 52. An outer seam 106 of the end compression element 54 may be angled or otherwise configured to abut and/or mate with the corresponding edge of the extrusion limiter 30. In a particular embodiment, the inner seam 104 may have an acute angle less than about ninety degrees and the outer seam 106 about a thirty-six degree angle. The end compression elements 54 may be otherwise suitably shaped.

Figure 4:
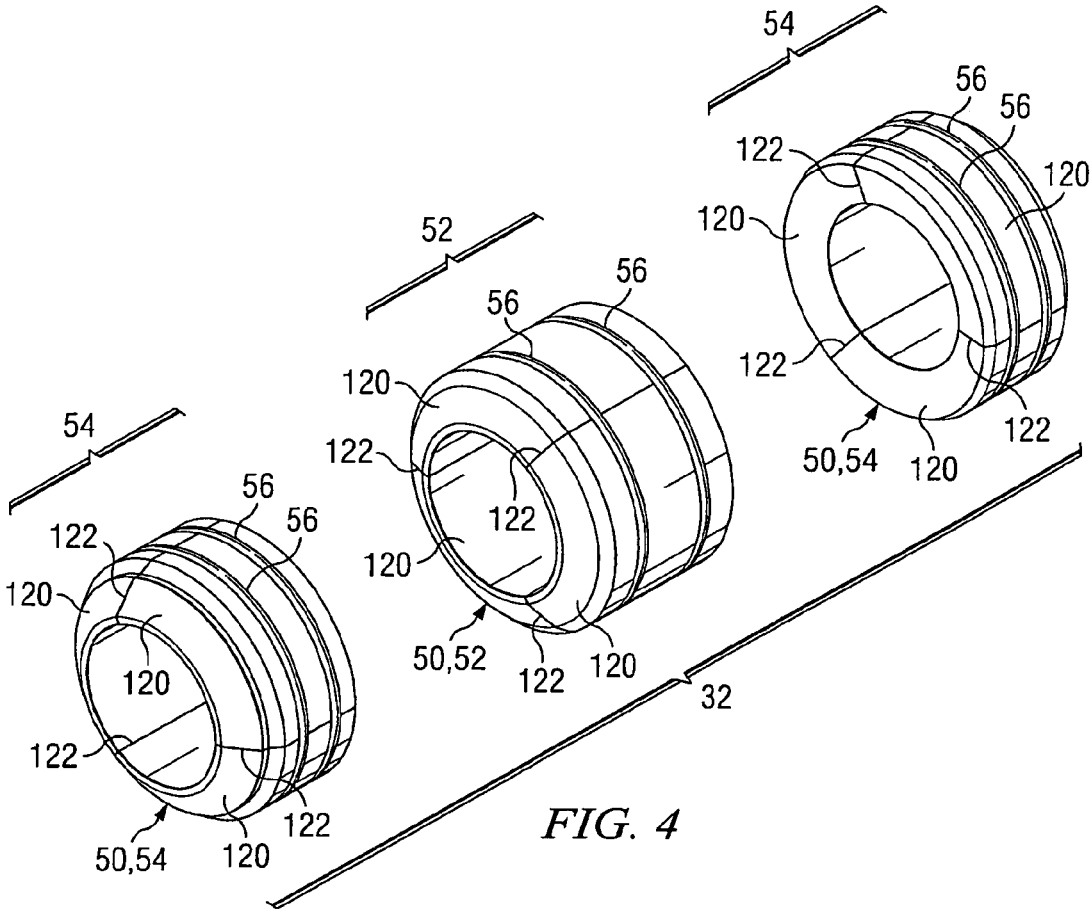
FIG. 4 illustrates one embodiment of segmentation of the compression elements of the disposable downhole tool of FIG. 1.

FIG. 4 illustrates one embodiment of segmentation of the compression elements 50. In this embodiment, the sealing element 32 comprises the center compression element 52 and the end compression elements 54. Each of the center compression element 52 and end compression elements 54 are segmented into a plurality of segments 120 by preconfigured divisions 122.

The one or more preconfigured divisions 122 are fully formed in the compression elements 50 at least at disposal of the disposable well plug 12. Thus, the preconfigured divisions 122 may be partially or fully formed prior to deployment of the disposable well plug 12 or partially or fully formed during deployment of the disposable well plug 12. In the latter embodiment, the preconfigured divisions 122 may be partially or fully formed in response to at least a segmenting event, which may be a disposal event such as destruction of a substantial part of the disposable well plug 12 or an operational event such as upon the setting and/or release of the disposable well plug 12.

In a specific embodiment, the preconfigured divisions 122 may be fully formed prior to deployment of the disposable well plug 12 with the compression elements 50 held together by the retaining rings 56, glue or other adhesive, interlocking geometry, or otherwise. Where an adhesive is used, the compression elements 50 may fracture downhole. Where an interlocking geometry is used, the compression elements 50 may release upon, for example, release of the disposable well plug 12.

In another embodiment, for example, the preconfigured divisions 122 may be substantially formed prior to deployment and may be completed upon release of the disposable well plug 12 from a set position at disposal of the disposable well plug 12. The preconfigured divisions 122 may be otherwise suitably formed in the compression elements 50 without departing from the scope of the present invention.

The preconfigured divisions 122 are preconfigured in that they are fully, substantially, or otherwise partly formed prior to deployment of the disposable well plug 12 or fully, substantially, or otherwise partially formed during deployment of the disposable well plug 12 in response to at least one predefined event designed to form or initiate formation or completion of the preconfigured divisions 122 at a point, area, or section of the compression element 50.

The preconfigured divisions 122 may be a cut or other separation of part of a compression element 50 from another part of the compression element 50. The preconfigured divisions 122 may be axial, lateral, longitudinal, straight, angled, curved, simple, complex, interlocking, wrapping, or otherwise. In one embodiment, the preconfigured divisions 122 are configured to allow segmentation of the compression elements 50 while preventing fluid from flowing through the sealing element 32 when the disposable well plug 12 is in the set position.

The segments 120 formed by preconfigured divisions 122 may be substantially uniform in shape or size or disparate from one another. The segments 120 may be directly or indirectly bound or otherwise held together or held in place relative to each other during deployment of the disposable well plug 12. The segments 120 may have a specific gravity or be otherwise suitably configured to sink or rise in a wellbore.

Referring to FIG. 4, in the illustrated embodiment, the preconfigured divisions 122 are preformed in the center compression element 52 and the end compression elements 54 prior to deployment of the disposable well plug 12. Also in this embodiment, the preconfigured divisions 122 are each a straight longitudinal cut, or divide, through a compression element 50. As previously described, in other embodiments, the preconfigured divisions 122 may be substantially but not entirely preformed or otherwise partially preformed prior to deployment of the disposable well plug 12. In this embodiment, the preconfigured divisions 122 in the compression elements 50 may be completed during deployment of the disposable well plug 12, release of the disposable well plug 12 in a wellbore, or otherwise.

The preconfigured divisions 122 in the end compression elements 54 may be offset from the preconfigured divisions 122 in the center compression element 52 such that no set of preconfigured divisions 122 extend longitudinally through the entirety of the sealing element 32. Offset of the preconfigured divisions 122 may prevent, reduce, or minimize any leakage longitudinally of fluids across the sealing element 32 along the axis of elongated body 20 when the disposable well plug 12 is in the set position. The preconfigured divisions 122 may be otherwise suitably offset or partially or otherwise aligned without departing from the scope of the present invention.

As illustrated, the segments 120 may each be substantially uniform in size and shape and comprise substantially one third of the associated compression element 50. Each of the compression elements 50 may include one or more recessed channels configured to receive the retaining rings 56 to hold the segments 120 together during deployment of the disposable well plug 12. The retaining rings 56 may be otherwise suitably positioned on or about the compression elements 50. In addition, when the preconfigured divisions 122 are not substantially preformed prior to deployment, the retaining rings 56 may be omitted. The retaining rings 56 may have characteristics or be made of a material that is the same as or comparable with the corresponding compression element 50 or may be suitably varied.

Figure 5:
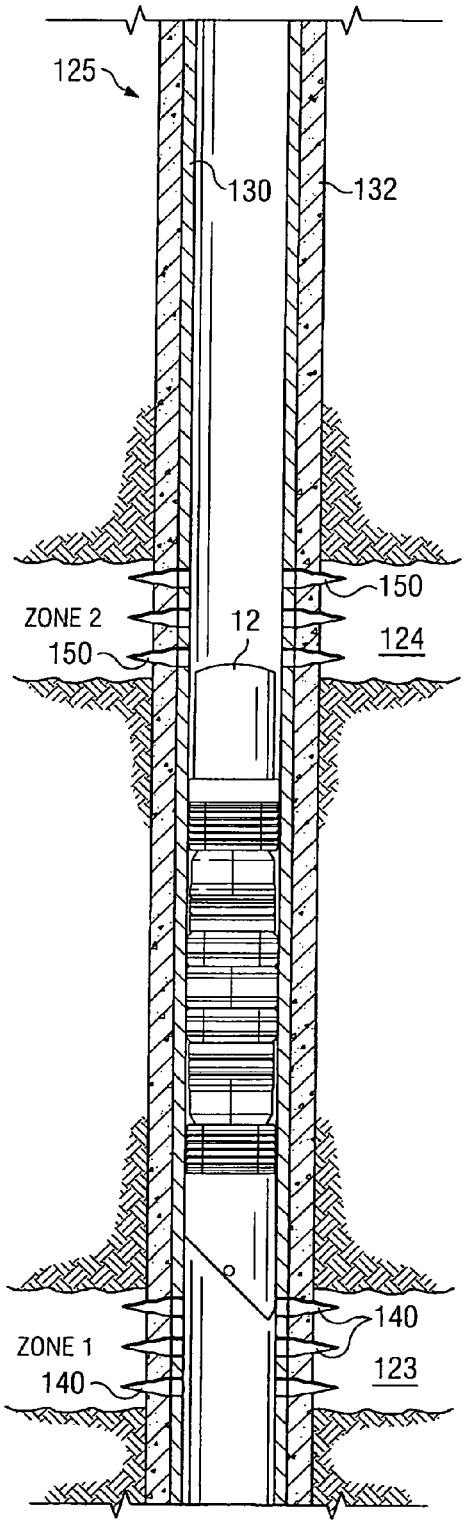
FIG. 5 illustrates one embodiment of deployment of a disposable downhole tool in a wellbore.
Figure 6:
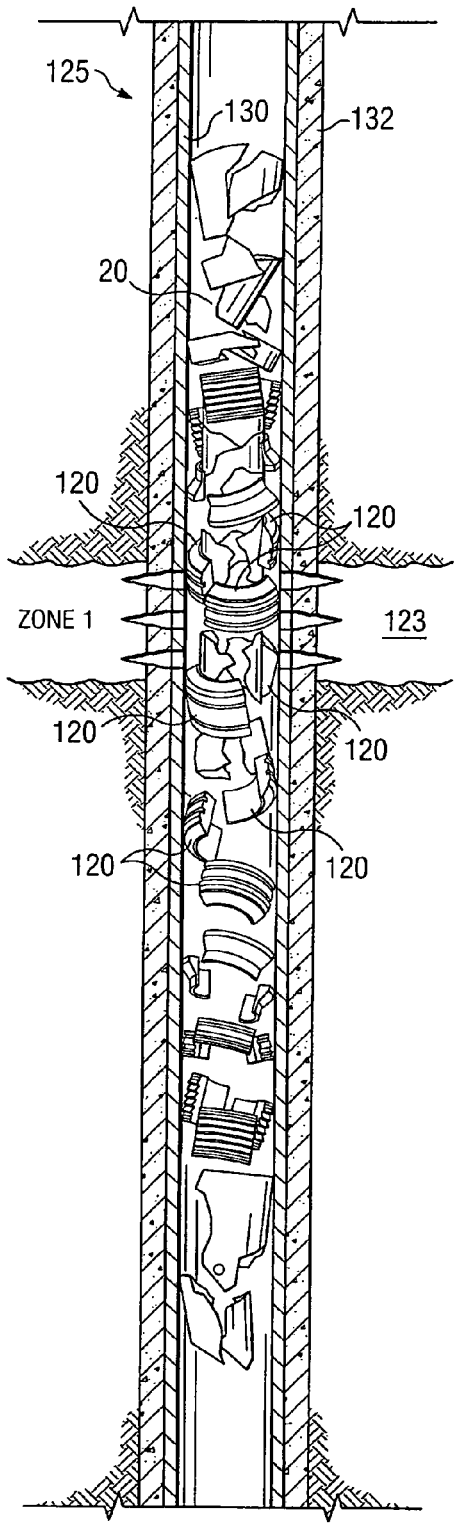
FIG. 6 illustrates one embodiment of disposal of the disposable downhole tool of FIG. 5.

FIGS. 5–6 illustrate use of the disposable well plug 12 in a wellbore in connection with a downhole process. The process may be a well completion process, a production enhancement process, or other suitable process for treating a wellbore. In the illustrated embodiment, the disposable well plug 12 is used in connection with a fracture process.

Referring to FIGS. 5–6, a wellbore 125 includes a first, or lower, production zone (Zone 1) 123 and a second, or upper, production zone (Zone 2) 124. The wellbore 125 is cased with casing 130 and cemented with cement 132.

Initially, a plurality of perforations 140 are formed in the casing 130 and cement 132 at the first production zone 123. The perforations 140 may be formed by lowering a perforating tool (not shown) into the wellbore 125, performing the perforation operation, and thereafter removing the perforating tool from the wellbore 125.

After formation of the perforations 140, the first production zone 123 may be stimulated by pumping a fracture, or frac, fluid into the wellbore 125. The fracture fluid passes from the wellbore 125 through the perforations 140 into the first production zone 123. The fracture fluid may be introduced into wellbore 125 by, in one embodiment, lowering a fracture tool containing discharge nozzles or jets for discharging the fracture fluid at a high pressure or, in another embodiment, by pumping the fracture fluid directly from a rig or pump truck directly into the wellbore 125. After completion of the fracing operation, production fluids may pass from the first production zone 123, through perforations 140, and into the wellbore 125 for production to the surface.

The disposable well plug 12 may be deployed in the wellbore 125 between the second production zone 124 and the first production zone 123 upon completion of the fracture operation for the first production zone 123. The disposable well plug 12 may be conventionally deployed by lowering the disposable well plug 12 on a work string (not shown) and setting for the disposable well plug 12 mechanically by twisting the work string or otherwise. The disposable well plug 12 may also be set by other suitable means such as electrical setting. During the setting operation, the sealing element 32 of the disposable well plug 12 is radially expanded to create a seal between the disposable well plug 12 and the casing 130 of the wellbore 125. The disposable well plug 12 seals the wellbore 125 between the second production zone 124 and the first production zone 123 to prevent fracture fluids used in connection with the second production zone 124 from entering into the first production zone 123.

After the disposable well plug 12 is set in the wellbore 125, a plurality of perforations 150 may be conventionally formed in the casing 130 and cement 132 at the second production zone 124. The second production zone 124 may then be stimulated by pumping a fracture fluid into the wellbore 125 as previously described. The fracture fluid flows through the wellbore 125 through the perforations 150 and into the second production zone 124. The disposable well plug 12 prevents fracture fluid from passing down to the first production zone 123.

After the completion of the fracing operation for the second production zone 124, the disposable well plug 12 may be disposed of in the wellbore 125. In one embodiment, the disposable well plug 12 may include a small quantity of explosives (not shown) to break up and/or loosen the slips 26, wedges 28, extrusion limiters 30, and/or sealing element 32. In this and other embodiments, the compression elements 50 are segmented either prior to deployment, during deployment, and/or during detonation of the explosives or other disposal event. Segmentation of the compression elements 50 may prevent the compression elements 50 from wedging in the wellbore 125 and/or prevent the compression elements 50 from wedging the elongated body 20 or other part of the disposable well plug 12 in the wellbore 125.

Upon disposal, the elongated body 20, pieces of the slips 26, wedges 28, and extrusion limiters 30, as well as segments 120 of the compression elements 50 may sink to a bottom of the wellbore 125, which may be a rat hole, a lateral, or other horizontal bore. In this embodiment, disposal of the disposable well plug 12 at the bottom of the wellbore 125 may prevent any part of the disposable well plug 12 from interfering with production operations of the wellbore 125. In another embodiment, the segments 120 of the compression elements 50 may be weighted or otherwise configured to rise in the wellbore 125. In this embodiment, the segments 120 may be removed from the wellbore 125 by circulation or other suitable operation. After disposal of the disposable well plug 12, the first and second production zones 123 and 124 may be produced, completed, or other operations may be performed. This operation may be repeated along the wellbore 125 in the upward direction. For example, a plurality of disposable well plugs 12 may be disposed of sequentially or in groups.

Figure 7:
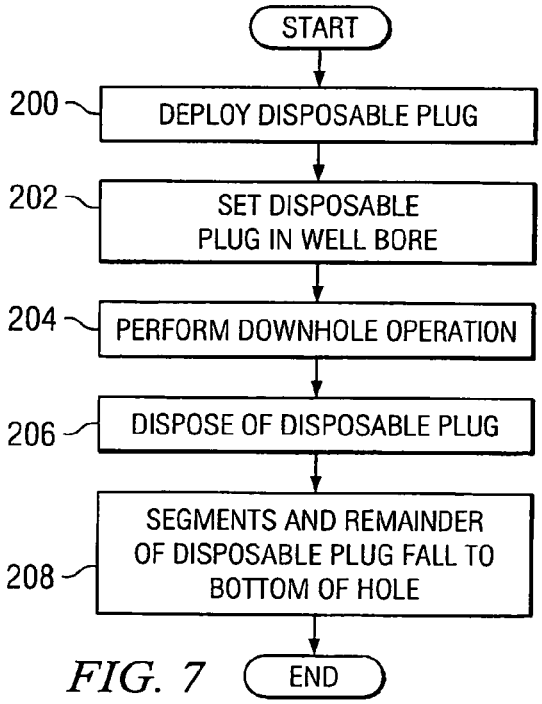
FIG. 7 illustrates one embodiment of a method for deploying and disposing of a disposable downhole tool.

FIG. 7 illustrates a method for deploying and using the disposable downhole tool 10. The method will be described in connection with the disposable well plug 12. The method may be used in connection with any other suitable disposable downhole tool 10.

Referring to FIG. 7, the method begins at step 200 in which the disposable well plug 12 is deployed in the wellbore 125. As previously described, the disposable well plug 12 may be deployed on a work string. The work string may comprise segmented or coiled tubing. At step 202, the disposable well plug 12 is set in the wellbore 125. The disposable well plug 12 may be set by mechanical, fluid, or other suitable mechanism.

Proceeding to step 204, a downhole operation is performed in the wellbore 125 with the disposable well plug 12 isolating a lower portion of the wellbore 125 from the portion in which the operation is being performed. The downhole operation may be a stimulation or other production enhancement operation such as fracing, acidizing, or the like or any other suitable completion, production, workover, or other operation. At step 206, the disposable well plug 12 is disposed of in the wellbore 125. The disposable well plug 12 may be disposed of during and/or as part of release, which may be performed by twisting of the work string or other suitable process such as electrical or wire line. In another embodiment, the disposable well plug 12 may be released by detonation of explosives within the disposable well plug 12.

Prior to and/or during disposal, the compression elements 50 of the disposable well plug 12 are segmented. As previously described, the compression elements 50 may be presegmented prior to deployment of the disposable well plug 12, partially segmented prior to deployment of the disposable well plug 12, and/or entirely segmented during deployment and/or disposal of the disposable well plug 12. Thus segmentation may occur at any suitable point or points of the method.

At step 208, the segments 120 and remainder of the disposable well plug 12 are disposed of in the wellbore 125. In one embodiment, the segments 120 of the compression elements 50 and the remainder of the disposable well plug 12 may be weighted or otherwise configured to sink in the wellbore 125. Thus, the disposable well plug 12 will not interfere with further production or other operations in the wellbore 125.

Although the present invention has been described in several embodiments, various changes and modifications may be suggested to one skilled in the art. It is intended that the present invention encompass such changes and modifications as fall within the scope of the appended claims.

What is claimed is:

1. A disposable downhole tool, comprising: an elongated body; a slip situated about the elongated body, wherein the slip comprises a plurality of segments; a compression element situated about the elongated body; and at least one preconfigured division in the compression element for disposal of the disposable downhole tool, wherein the compression element is purposely fractured along the preconfigured division after the disposable downhole tool has been set.

2. The disposable downhole tool of claim 1 wherein the compression element for disposal of the disposable downhole tool comprises a plurality of preconfigured divisions segmenting the compression element into a plurality of segments.

3. The disposable downhole tool of claim 2 wherein the segments are substantially uniform in size.

4. The disposable downhole tool of claim 2 wherein the segments are substantially uniform in shape.

5. The disposable downhole tool of claim 2 wherein the compression element comprises an elastomer.

6. The disposable downhole tool of claim 5 wherein the elastomer has a shore durometer A scale hardness between about 40 and about 95.

7. The disposable downhole tool of claim 2 wherein the preconfigured divisions are at least partly formed downhole in response to at least one segmenting event.

8. The disposable downhole tool of claim 7 wherein the segmenting event comprises compression of the compression element.

9. The disposable downhole tool of claim 7 wherein the segmenting event comprises setting of the disposable downhole tool in a wellbore.

10. The disposable downhole tool of claim 7 wherein the segmenting event comprises releasing of the disposable downhole tool in a wellbore.

11. The disposable downhole tool of claim 7 wherein the segmenting event comprises release of the compression element from a compression state.

12. The disposable downhole tool of claim 7 wherein the segmenting event comprises destruction of one or more substantial structural parts of the disposable downhole tool in a wellbore.

13. The disposable downhole tool of claim 2 wherein the preconfigured divisions are at least partially formed prior to deployment of the disposable downhole tool in a wellbore.

14. The disposable downhole tool of claim 2 wherein the segments are configured to sink in a wellbore.

15. The disposable downhole tool of claim 2 wherein the segments are configured to rise in a wellbore.

16. The disposable downhole tool of claim 2 wherein the preconfigured divisions are substantially parallel to a longitudinal axis of the disposable downhole tool.

17. The disposable downhole tool of claim 2 wherein the preconfigured divisions segment the compression element into three or more segments.

18. The disposable downhole tool of claim 2 wherein the preconfigured divisions at least substantially segment the compression element into the plurality of segments prior to deployment of the disposable downhole tool in a wellbore, and further comprising a retainer to retain the segments in place about the elongated body while positioning the disposable downhole tool in a wellbore.

19. The disposable downhole tool of claim 18 wherein the retainer comprises an o-ring.

20. The disposable downhole tool of claim 19 wherein the o-ring is external to the compression element.

21. The disposable downhole tool of claim 18 wherein the retainer comprises a fracturable constraint.

22. The disposable downhole tool of claim 2 wherein: the preconfigured divisions at least substantially segment the compression element into a plurality of segments prior to deployment of the disposable downhole tool in a wellbore; and the plurality of segments are held together with an adhesive prior to deployment of the disposable downhole tool in the wellbore.

23. The disposable downhole tool of claim 2 wherein: the preconfigured divisions at least substantially segment the compression element into a plurality of segments prior to deployment of the disposable downhole tool in a wellbore; and the plurality of segments are held together by an interlocking geometry prior to deployment of the disposable downhole tool in the wellbore.

24. The disposable downhole tool of claim 1 further comprising a plurality of compression elements, wherein each compression element has at least one preconfigured division at disposal of the disposable downhole tool.

25. The disposable downhole tool of claim 24 wherein the preconfigured division of a first compression element is offset from the preconfigured division of an adjacent second compression element.

26. The disposable downhole tool of claim 1 wherein the compression element is at least part of a sealing element of the disposable downhole tool.

27. The disposable downhole tool of claim 1 wherein the disposable downhole tool comprises a disposable well plug.

28. A disposable downhole tool, comprising: an elongated cylindrical body; and an external sealing element situated about the elongated cylindrical body, wherein the external sealing element comprises a plurality of sealing rings each presegmented into a plurality of segments, wherein the sealing element is purposely fractured along the plurality of segments after the disposable downhole tool has been set.

29. A disposable downhole tool, comprising: a body; a slip situated about the body, wherein the slip comprises a plurality of segments; and a compression element coupled about the body, wherein the compression element is preconfigured at predefined locations for segmentation into a plurality of segments for disposal of the downhole tool in a wellbore, wherein the compression element is purposely fractured along the predefined locations after the disposable downhole tool has been set.

30. The disposable downhole tool of claim 29 wherein the compression element comprises a sealing ring situated about the body.

31. The disposable downhole tool of claim 29 wherein the disposable downhole tool comprises a disposable well plug.

32. A method for disposing of a downhole tool, comprising the steps of: deploying the downhole tool in a wellbore; setting the downhole tool in the wellbore; releasing the downhole tool in the wellbore; and segmenting a compression element and a slip of the downhole tool to aid disposal of the downhole tool in the wellbore, wherein the compression element and the slip purposely fracture along the segments after the downhole tool has been set.

33. The method of claim 32 further comprising the step of segmenting the compression element of the downhole tool in response to at least a downhole event.

34. The method of claim 32 wherein the compression element of the downhole tool is at least substantially presegmented prior to deployment of the downhole tool in the wellbore.

35. The method of claim 32 further comprising the step of segmenting the compression element of the downhole tool in connection with setting the downhole tool in the wellbore.

36. The method of claim 32 further comprising the step of segmenting the compression element of the downhole tool in connection with releasing the downhole tool in the wellbore.

37. The method of claim 32 further comprising the step of segmenting the compression element of the downhole tool into a plurality of segments.

38. The method of claim 32 wherein the compression element comprises at least part of a sealing element of the downhole tool.

* * * * *